United States Patent [19]

Amann et al.

[11] Patent Number: 4,719,889

[45] Date of Patent: Jan. 19, 1988

[54] FUEL INJECTION INSTALLATION FOR AN INTERNAL COMBUSTION ENGINE

[75] Inventors: Gernot Amann, Hohenems, Austria; Christian Mathis, Arbon, Switzerland

[73] Assignees: Dereco Dieselmotoren Forschungsund Entwicklungs-AG, Arbon, Switzerland; IVECO Fiat S.p.A., Turin, Italy

[21] Appl. No.: 4,706

[22] Filed: Jan. 20, 1987

[30] Foreign Application Priority Data

Jan. 22, 1986 [CH] Switzerland ..... 237/86

[51] Int. Cl.[4] ..... F02M 39/00

[52] U.S. Cl. ..... 123/447; 123/467; 123/456

[58] Field of Search ..... 123/446, 447, 458, 456, 123/467, 496

[56] References Cited

U.S. PATENT DOCUMENTS

| | | | |
|---|---|---|---|
| 3,416,506 | 12/1968 | Steiger | 123/447 |
| 4,161,161 | 7/1979 | Bastenhof | 123/447 |
| 4,300,509 | 11/1981 | Schechter | 123/456 |
| 4,440,132 | 4/1984 | Terada | 123/467 |
| 4,545,352 | 10/1985 | Jourde | 123/447 |
| 4,554,903 | 11/1985 | Straubel | 123/447 |
| 4,627,403 | 12/1986 | Matsumura | 123/447 |
| 4,674,448 | 6/1987 | Steiger | 123/447 |

FOREIGN PATENT DOCUMENTS

| | | | |
|---|---|---|---|
| 2045347 | 10/1980 | United Kingdom | 123/447 |

*Primary Examiner*—Carl Stuart Miller

*Attorney, Agent, or Firm*—Werner W. Kleeman

[57] ABSTRACT

Upstream of the electrically operated fuel injectors for each engine cylinder there is connected a common pressure reservoir subject via a valve to the action of a continuously delivering fuel pump as a function of the engine speed and load. The common pressure reservoir is continuously connected by means of an annular chamber and a throttle to a channel in each fuel injector. Each fuel injector has a solenoid or magnetic valve operable for each fuel injection process and during the operation thereof connects said channel with a fuel return pipe and consequently relieves or releases the nozzle needle closing the fuel injection opening, thus releasing the discharge of fuel from a pressure chamber located directly upstream of the fuel injection opening. The channel is continuously connected via a throttle bore bridging a check valve to a control chamber controlling the nozzle needle movement. The pressure chamber is connected to a second pressure chamber associated with the related fuel injector and located in the vicinity thereof and is connected by the second pressure chamber to the common pressure reservoir. The fuel injection course can be influenced by the size of the throttle bore and the subdivision of the fuel storage volume into two pressure chambers. It is in particular possible to delay the ascent in the fuel injection rate during the fuel injection starting phase and consequently to reduce combustion noise and the emission of pollutants.

12 Claims, 5 Drawing Figures

FUEL INJECTION INSTALLATION FOR AN INTERNAL COMBUSTION ENGINE

BACKGROUND OF THE INVENTION

The present invention relates to a new and improved fuel injection installation or fuel injection means for an internal combustion engine, especially a diesel engine.

Generally speaking, the inventive fuel injection installation for an internal combustion engine, especially a diesel engine, is of the type comprising at least one electrically operated fuel injector for each engine cylinder and a common pressure reservoir connected upstream of the fuel injectors and subject to the action of a continuously delivering fuel pump as a function of the engine speed and load. The common pressure reservoir is continuously connected by means of an annular chamber and a throttle to a channel in each fuel injector. Each fuel injector is provided with a solenoid or magnetic valve operable for each fuel injection process and which, when operated, connects the channel to a fuel return pipe and consequently relieves or releases the nozzle needle closing the fuel injection opening of the associated fuel injector and releases the discharge of fuel from a pressure chamber located directly upstream of the fuel injection opening.

In the case of a fuel injection installation or fuel injection means of this type as known from German Patent No. 3,227,742, the annular chamber continuously connected to the pressure reservoir and in which the fuel enters the particular fuel injector is continuously connected via a throttle to the storage chamber or zone directly behind the closable fuel injection opening.

If in the case of a currentless solenoid or magnetic valve, the nozzle needle closes the fuel injection opening then throughout the inner chamber or area of the fuel injector between the nozzle needle seat and the solenoid or magnetic valve body, the set fuel pressure is fully built up and together with a spring presses the nozzle needle against its seat. On operating the solenoid or magnetic valve, the solenoid valve body releases the outflow of fuel from the aforementioned annular chamber via throttles into a fuel return pipe to the fuel tank. The full pressure acting from the storage chamber or zone on the piston of the nozzle needle can now raise the same from the seat against the action of its spring and the pressure drop on the other side of the nozzle needle piston. The fuel previously under high pressure in the storage chamber or zone is relieved and passes out of the fuel injection opening.

As a result, the fuel injection rate rises sharply, reaches its maximum immediately after opening the fuel injection nozzle and then slowly drops, because the fuel flowing into the storage chamber cannot compensate the pressure drop. As soon as the solenoid or magnetic valve becomes currentless again, the pressure above the nozzle needle piston builds up again and, aided by the spring, presses the nozzle needle into its position closing the fuel injection opening, after which the full fuel pressure again builds up in the storage chamber.

This known fuel injection installation results in a good precision of the fuel injection time and the fuel injection quantity, as well as in an economical fuel consumption. However, the course of each individual fuel injection operation is disadvantageous with respect to the emission of pollutants, particularly the discharge of nitrogen oxides. It also leads to a comparatively high combustion noise level. The known fuel injection installation scarcely makes it possible to reduce these disadvantages.

SUMMARY OF THE INVENTION

Therefore with the foregoing in mind it is a primary object of the present invention to provide a new and improved construction of a fuel injection installation for an internal combustion engine, especially a diesel engine, which is not afflicted with the afore-discussed shortcomings and limitations of the prior art.

Another significant object of the present invention is, while retaining the advantages of the prior art fuel injection installation, to improve the same with respect to the emission of pollutants and noise.

Still a further beneficial object of the present invention is to provide a new and improved construction of a fuel injection installation or system for an internal combustion engine, which fuel injection installation or system is relatively simple in construction and design, extremely reliable in operation, quite economical to manufacture, affords precise injection of fuel into the internal combustion engine, and requires a minimum of maintenance and servicing.

Now in order to implement these and still further objects of the present invention which will become more readily apparent as the description proceeds, the fuel injection installation of the present development is manifested by the features that each fuel injector contains a conduit or channel having a length matched to the ignition delay time, and the pressure chamber which is located directly upstream of the fuel injection opening of each fuel injector is connected by such conduit or channel to a further pressure chamber associated with such fuel injector and by means of this further pressure chamber to the common pressure reservoir.

Through the subdivision of the fuel storage volume of each fuel injector into two pressure chambers interconnected by a conduit or channel or line of given length, it is possible to adapt in an optimum manner the fuel injection course to the requirements of a specific engine. The pressure chamber positioned directly upstream of the fuel injection opening can be made smaller than in the afore-discussed known construction, so that in the initial fuel injection phase the pressure upstream of the fuel injection opening initially drops comparatively more rapidly.

In order to be able to inject the same fuel quantity in the case of a noise-reducing reduction of the fuel injection rate at the start of the fuel injection process within the predetermined fuel injection time, it is necessary to increase the fuel injection rate towards the end of the fuel injection process. This can be brought about by the inventive subdivision of the fuel storage volume into two pressure chambers and the direct connection thereof to the common pressure reservoir.

It is advantageous if the channel associated via the throttle with the annular chamber is continuously connected via a throttle bore bridging a check valve to a control chamber controlling the nozzle needle movement. As a result of a delayed opening movement of the nozzle needle controlled in this way, it is possible to bring about a comparatively slowly increasing fuel flow through the nozzle at the start of the fuel injection process. As a result of the initially low fuel injection rate, the fuel quantity injected during the ignition delay time is reduced, which leads to less noise and reduced nitrogen oxide emissions. There can also thus result a comparative improvement in the efficiency for the same or a shorter fuel injection time by means of a higher pressure.

It is admittedly already known from French Patent No. 2,541,379 to control the needle lift or travel by means of a bore bridging the check valve. However, due to the special design of the fuel injection stroke limitation in this known construction, the control chamber must be made comparatively large in order to ensure the clearance needed for an adequate opening of the nozzle needle. Thus, in this known means, at the start of the fuel injection process there is a sudden rise in the fuel flow before the bore bridging the check valve can develop its action, which once again leads to undesired noise production.

The further or second pressure chamber of each inventive fuel injector can be formed by a pressure tank, which is located close to the fuel injector in a fuel feed pipe between the common pressure reservoir and the relevant fuel injector. However, it could also be formed by corresponding dimensioning of a part or section of the fuel feed pipe.

By positioning a throttle in a fuel feed pipe between the common pressure reservoir and the individual fuel injectors, it is possible to bring about a further improvement by thereby reducing pressure fluctuations in the further or second pressure chambers.

According to a preferred embodiment of the invention, that part of the check valve in which the bridging or through-passing throttle bore is formed is an easily replaceable disk. Thus, by inserting or replacing such disk by a disk with a larger or smaller throttle bore, it is possible to bring about a larger or smaller delay in the fuel injection rate in the initial fuel injection phase and consequently to optimize the fuel injection course of a particular engine and/or bring about matching of the fuel injection course of the individual fuel injectors of an engine.

The short and very precise switching-in or starting times required in operation by the fuel injectors of such fuel injection means require extremely short, as well as small and precisely adjustable stroke lengths of the solenoid or magnetic valve.

According to a further development of the present invention, this is achieved in that the solenoid or magnetic valve body is constructed as an armature and slides in an armature guide part and that the valve body and armature guide part are interchangeable. This construction makes it possible in a very simple way, namely through an appropriate choice of the length of only these two interchangeable parts to optimize the stroke length and reduce tolerances between the solenoid or magnetic valves of the fuel injectors of an engine.

The arrangement is preferably designed such that between the magnet core parts of the solenoid or magnetic valve or between these and the armature there is provided a non-magnetic spacer. For example, for this purpose an air gap can interrupt the magnetic flux between the magnetic core parts. As a result the operating times of the solenoid or magnetic valve can be further improved in the sense of shortening the time lag, because then even with the armature attracted, an undesired magnetic force increase is prevented.

Advantageously, a valve metering the fuel is connected upstream of the fuel pump, which leads to a further fuel consumption improvement, because then the pump only has to bring to high pressure that fuel quantity effectively required by the system.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
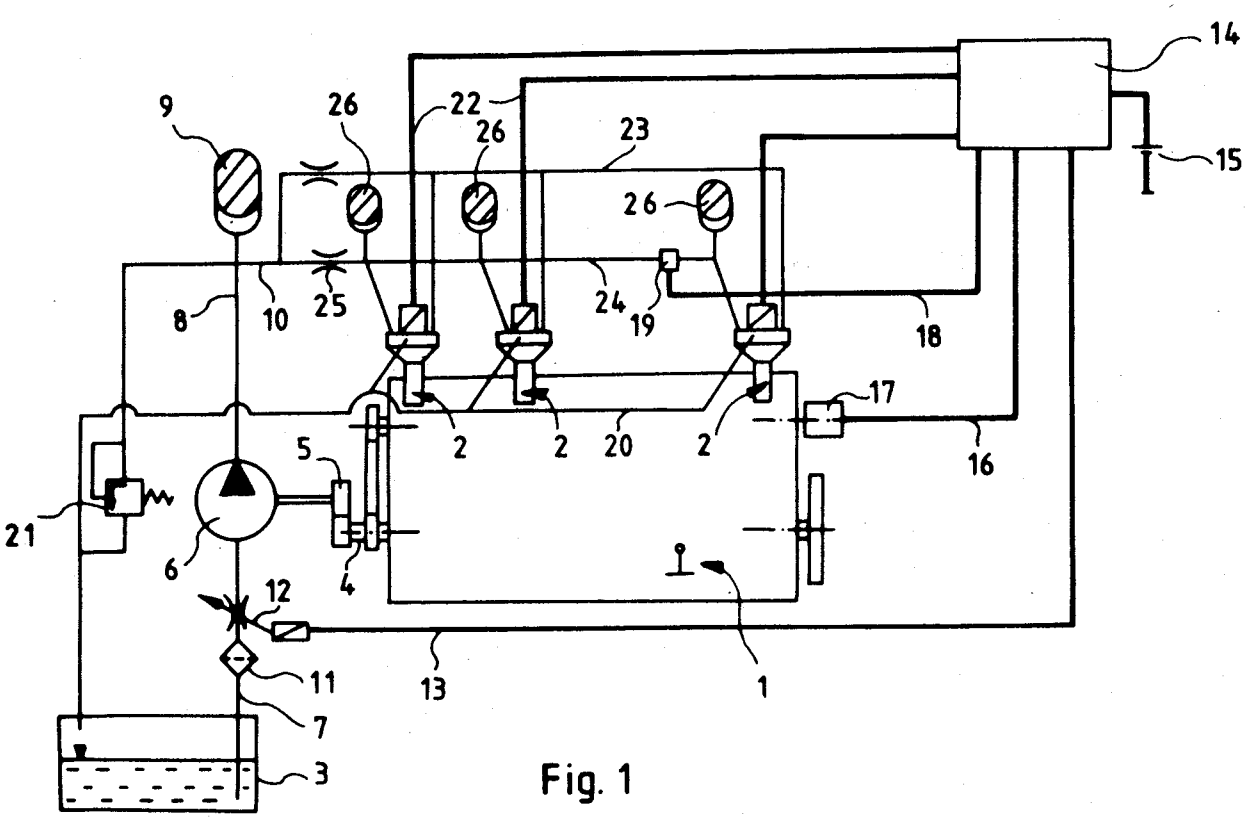
FIG. 1 shows the diagram of a fuel injection installation in a high-speed, multi-cylinder diesel engine.

Describing now the drawings, it is to be understood that to simplify the showing thereof, only enough of the fuel injection installation or means for an internal combustion engine has been illustrated therein as is needed to enable one skilled in the art to readily understand the underlying principles and concepts of the present invention. Turning specifically now to FIG. 1 of the drawings, reference numeral 1 generally designates a multi-cylinder diesel engine, whose fuel injectors 2 associated with each engine cylinder are supplied with fuel from a fuel tank 3. The fuel is drawn out of tank 3 by a high-pressure pump 6 by means of a suction pipe 7 and via a filter 11. This high-pressure pump 6 is driven by the main shaft 4 via a transmission or gear structure 5. The fuel is supplied via a pressure pipe 8 to a common pressure reservoir 9 and by a feed pipe or conduit 10 to the fuel injectors 2.

In the illustrated embodiment, a control or regulating valve 12 is placed in the suction pipe 7 upstream of the pump 6. Control valve 12 is connected via an electric line 13 to an output of an electronic control device 14 which is supplied by a battery 15. Apart from processing other data, the control device 14 processes data supplied thereto via an electric line 16 from a position and speed indicator 17 as well as, via an electric line 18, from a pressure sensor 19 which is here connected in the feed pipe or supply conduit 10 leading to the fuel injectors 2. Using such data, as a function of the engine speed, the load and other parameters, control device 14 controls the control valve 12 and via the volumetric efficiency of the high-pressure pump 6 variable therewith the fuel pressure prevailing in common pressure reservoir 9 and the feed pipe or conduit 10. The excess fuel in the fuel injectors 2 is collected in a fuel return pipe 20 and returned to fuel tank 3. A safety valve 21 is connected between the pressure pipe 8 and the fuel return pipe 20 and only opens in the case of a pressure not occurring under normal operating conditions and consequently limits to an adjustable value the maximum pressure in the system.

In place of the valve 21, described here only as a safety pressure release or excess pressure valve, it is possible to use, according to a variant embodiment, a control or regulating valve and adjusts the fuel pressure prevailing in fuel reservoir 9 and feed pipe 10 corresponding to the control valve 12 controlled by the control device 14. The individual fuel injectors 2 are also controlled by the control device 14 via electric lines 22 and which forms the shape and duration of the momentary electric signal on the basis of signals from the position and speed indicator 17 and other data.

In the illustrated construction, each fuel injector 2 has two fuel feed or supply pipes or conduits 23, 24. In the fuel feed or supply pipe 24, which also contains the pressure sensor 19, there is connected a throttle 25, as well as a pressure tank or pressure chamber 26 for each fuel injector 2.

Figures 2, 3:
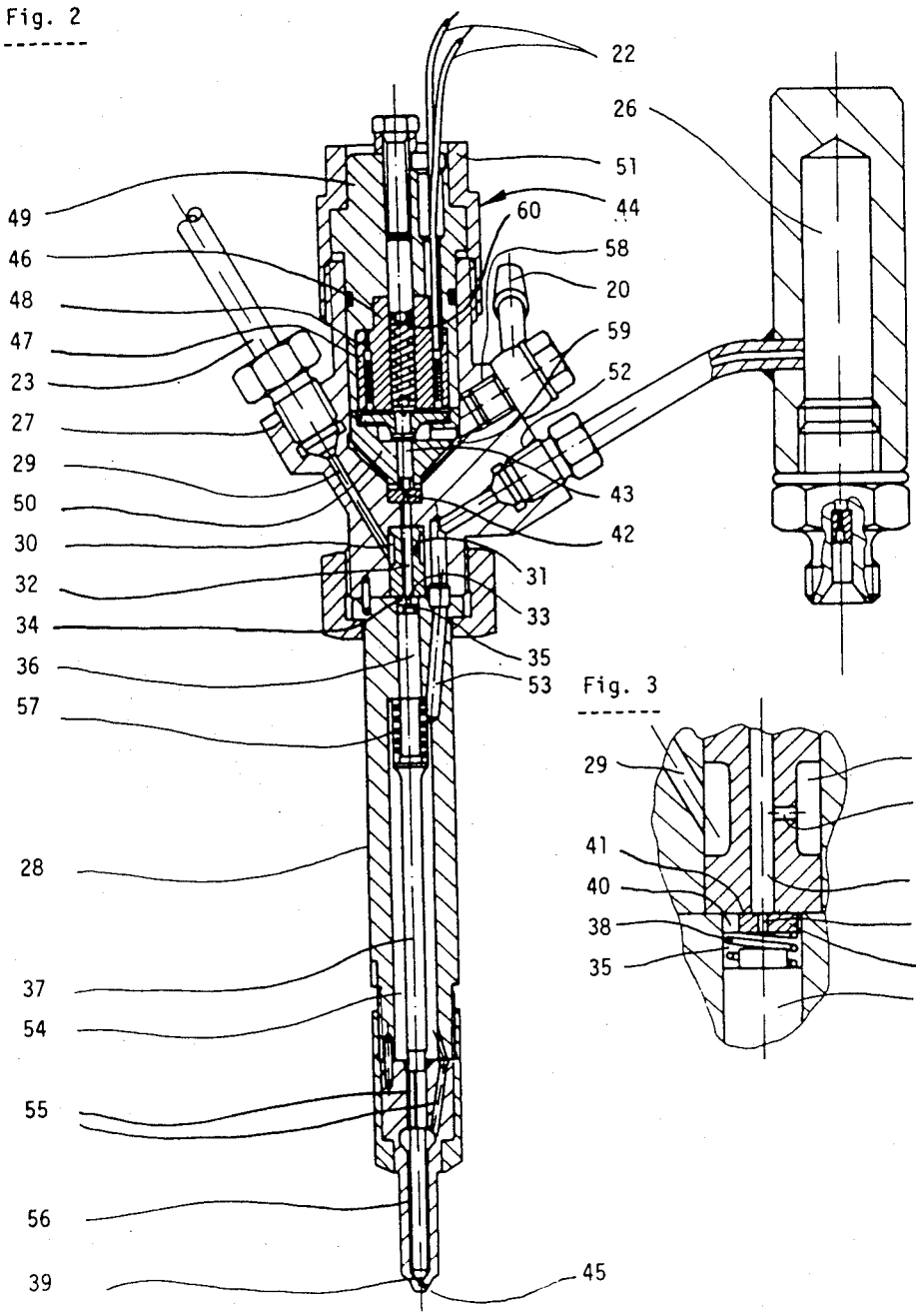
FIG. 2 shows detail of a single fuel injector in axial section.
FIG. 3 shows a larger-scale view of a detail from FIG. 2.

FIGS. 2 and 3 show an individual fuel injector 2 in detail and in section. At location 27, the feed pipe 23 is connected to the multipart casing 28 of fuel injector 2 and is connected through a channel 29 to an annular chamber 30. As is more clearly shown in FIG. 3, the annular chamber 30 is connected via a radial throttle bore 31 to a channel 32 which, towards the fuel injection end of the fuel injector 2 is constantly flow connected to a control chamber 35 via a throttle bore 33 formed in an interchangeable disk 34 defining a check valve. Control chamber 35 is sealingly closed in the direction of the fuel injection end of the fuel injector 2 by the piston 36 of a nozzle needle 37. A weak compression spring 38 (FIG. 3) is arranged between the piston 36 and the disk 34 having the throttle bore 33 and which slides axially in control chamber 35. This compression spring 38 attempts, on the one hand, to keep the nozzle needle 37 in its closed position, where it engages with its nozzle seat 39 provided in casing 28 and consequently closes the fuel injection opening 45 formed by one or more fuel injection nozzles, and, on the other hand, attempts to press the disk 34 against an annular shoulder 41 in casing 28 and which disk 34 acts as a check valve by virtue of the arrangement of the overflow openings 40 and thereby keep these openings 40 closed. As soon as the pressure in channel 32 exceeds that in control chamber 35, the disk 34 is raised from its seat on the annular shoulder 41 against the action of the spring 38 and these are thus freed the overflow openings 40 which have a cross-section several times larger than that of the throttle bore 33.

In the axial direction away from the fuel injection end of the fuel injector 2, the channel 32 issues into a throttle bore 42. When the fuel injector 2 is in the inoperative position, this throttle bore 42 is closed by the valve body 43 of a solenoid or magnetic valve 44 subject to the action of a compression spring 60. The solenoid or magnetic valve 44 comprises a core holder 49 and magnet core parts 46, 47, which form a gap 48 between them and defining a non-magnetic spacer. The same advantage can be achieved if the magnetic flux between the magnet core parts 46, 47 and the armature is interrupted, e.g. by a foil or some other non-magnetic spacer. The armature formed by the valve body 43 slides in an armature guide part 50. The magnet core parts 46, 47, like the core holder 49, have a common, carefully planar-worked end face. As can be seen, it is easily possible to replace the valve body 43 and armature guide part 50 after unscrewing a cap 51 closing the fuel injector 2.

The short and very precise starting or operating times required in operation by such fuel injectors 2 require from the solenoid or magnetic valve 44 extremely short, as well as small and precisely adjustable stroke lengths, which must be uniform for all the fuel injectors 2 of the same engine. The illustrated construction solves this requirement in a particularly appropriate manner. The arrangement of the magnet core parts 46, 47 in a core holder 49 and the valve body 43 acting as the armature in the armature guide part 50 makes it possible in a very simple manner, namely through an appropriate choice of the length of only these two, easily interchangeable parts 43, 50, to optimize the stroke length and to reduce tolerances between the solenoid or magnetic valves 44 of the fuel injectors 2 of the same engine. The solenoid or magnetic valve operating times can be further improved by the aforementioned interruption of the magnetic flux, particularly through the gap 48 between the magnet core parts 46, 47. The time lag between switching off the magnetic current and the movement of the valve body 43 is greatly shortened, because even with the armature or valve body 43 attracted or energized the gap 48 prevents a complete magnetic saturation of the magnet core parts 46, 47 and therefore an undesired magnetic force increase with attracted armature or valve body 43. In the described construction, the gap size can be particularly accurately produced. As the parts defining the gap 48 perform no movement, wear is also not expected, so that the clearance remains constant over the life of the particular fuel injector.

The pressure reservoir 9 common to all the fuel injectors 2 is connected, as shown in FIG. 1, to each individual fuel injector 2 by the fuel feed pipe 24 containing the throttle 25 and the individual pressure tanks or pressure chambers 26 associated with each fuel injector 2. The throttle 25 reduces pressure oscillations in the pressure tanks or pressure chambers 26. As can be gathered from FIG. 2, the fuel in fuel feed pipe 24 passes via a connection 52 of the casing 28 of any given fuel injector 2 and a conduit or channel 53 in the latter into a pressure chamber 54 located in the vicinity of the fuel injection opening 45. Thus, apart from a first pressure chamber in pressure tank 26, a second pressure chamber 54 is associated with each fuel injector 2. By means of channels 55 with an overflow cross-section, the second pressure chamber 54 is connected to the annular chamber 56 about the furthest forward part of the nozzle needle 37 upstream of the valve seat 39. A compression spring 57 in the casing 28 and acting on the nozzle needle 37 aids the action of the forces acting as a result of the different pressures relative to the nozzle needle piston 36 and the fuel injection opening 45, in order to press the nozzle needle 37 against the seat 39 with the fuel injector 2 in the inoperative state.

The connection of the fuel injector 2 to the fuel return pipe 20 is finally formed by a connection 58, which issues into an annular chamber 59 which, in the case of the solenoid or magnetic valve 44 being open, is connected to channel 32 via the throttle bore 42 which is then freed by the valve body 43.

The operation of any given fuel injector 2 will now be described. Solenoid or magnetic valve 44 is currentless between fuel injection processes. Under the action of the spring 60, the valve body 43 keeps the throttle bore 42 closed. Thus, the same pressure prevails in channel 32 as in the common pressure reservoir 9, because the two are connected via lines or conduits and throttles 25, 23, 29, 30, 31. The disk 34 is kept by the compression spring 38 in the position shown in FIG. 3. The overflow openings 40 are closed. The channel 32 and the control chamber 35 are interconnected only by the throttle bore 33. Through the pressure balance or equilibrium between the channel 32 and the control chamber 35, the nozzle needle 37 is surrounded by high pressure on all sides and is pressed against its seat 39 by spring 57. Thus, the fuel injection openings 45 are separated from the pressure chamber 54.

If the solenoid or magnetic valve 44 is now energized for initiating a fuel injection process, as soon as the applied magnetic force exceeds the opposing force of the spring 60, the valve body 43 moves in the direction of magnet core parts 46, 47 and frees the throttle bore 42. The pressure in the channel 32 drops to a value governed by the cross-sectional surfaces or faces of the throttle bores 31 and 42. Initially, the pressure drop in control chamber 35 takes place approximately as fast as that in the channel 32, because only very small liquid quantities must flow out for this purpose through the throttle bore 33. However, as soon as and because of the pressure drop in the control chamber 35 the nozzle needle 37 moves away from its seat 39 through the action of the pressure in the annular chamber 56 and the pressure chamber 54 and counter to the forces exerted by the springs 57 and 38, the liquid displaced by the nozzle needle 37 in the control chamber 35 must flow through the throttle bore 33 into the channel 32 and then there is no further drop in the pressure in the control chamber 35. The speed of nozzle needle 37 can be influenced by the cross-sectional surface of the throttle bore 33.

As a result of the immediately decelerated or braked opening movement of the nozzle needle 37, the cross-sectional surface of the fuel injection nozzle bores is only freed in a slower manner and, right from the start of the fuel injection, the fuel injection rate has the desired rise or ascent.

As a result of the outflow of fuel from the relatively small pressure chamber 54, there is a pressure drop therein, which ensures a further fuel injection rate reduction in the second opening phase despite the somewhat larger needle stroke. Following a roughly double shaft running time between the pressure chambers 54 and 26, following the first pressure drop in the pressure chamber 54, there takes place the start of return flow of fuel via conduit or channel 53 into pressure chamber 54. Thus, the original pressure in the pressure chamber 54 and the annular chamber 56 is approximately reached again which now, in combination with the nozzle needle 37 engaging on disk 34, leads to a high fuel injection rate.

As soon as the solenoid or magnetic valve 44 is switched off, the valve body 43 can be moved by the spring 60 back into the original inoperative position. With the throttle bore 42 closed, the pressure in the channel 32 rises and presses the nozzle needle 37 and the disk 34, together with the spring 57 on to its seat, counter to the somewhat lower pressure in the pressure chamber 54. Thus, the fuel injection process is ended and there can once again be an inoperative or rest state for the next fuel injection operation in the channels and pressure chambers. The same relatively long time is also available for the spring 38 to move the disk 34 into its position shown in FIG. 3.

Figure 4:
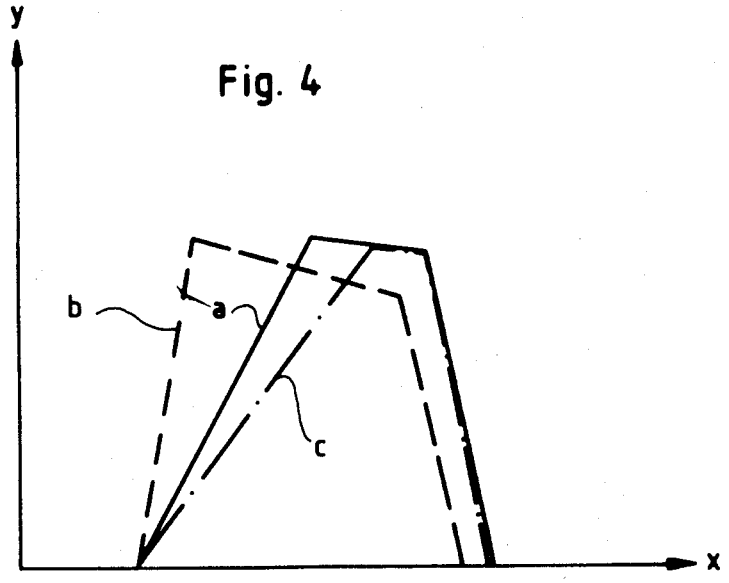
FIGS. 4 and 5 show graphs of different fuel injection courses.

FIG. 4 graphically shows the described fuel injection course in a coordinate system, the time being plotted on the abscissa X and the fuel flow on the ordinate y. The area bounded by the particular curve and the abscissa consequently corresponds to the fuel quantity supplied per individual fuel injection.

The unbroken line curve a represents the fuel injection course for a fuel injector 2 according to the invention. The broken line curve b represents the fuel injection course in the case of a known fuel injector, e.g. according to the aforementioned German Patent No. 3,227,742. It can be clearly seen that in the case of the known fuel injector (curve b), the fuel injection rate rises very sharply in the initial fuel injection phase and reaches its maximum immediately following the start of fuel injection and then immediately starts to fall due to the pressure drop in the reservoir, whereas in the case of the inventive fuel injector 2 (curve a), as a result of the measures according to the invention the fuel injection rate in the initial phase rises less sharply in delayed manner, which leads to a reduction in noise and pollutant emissions and then after reaching its maximum remains virtually constant up to the sudden drop at the end of the fuel injection process. Whereas, in the known fuel injector, the indicated very sharp rise in the fuel injection rate cannot be modified in the initial phase of a fuel injection, this is possible with the inventive fuel injector, namely through changing the size of the throttle bore 33 in the disk 34, e.g. by replacing the disk 34 by another disk with a different size bore. Using the example of the dot-dash curve c in FIG. 4, the course of the fuel injection is represented with an even shallower or flatter rise of the fuel injection rate as obtained with a fuel injector 2, whose throttle bore 33 is smaller than that used as a basis for curve a.

Figure 5:
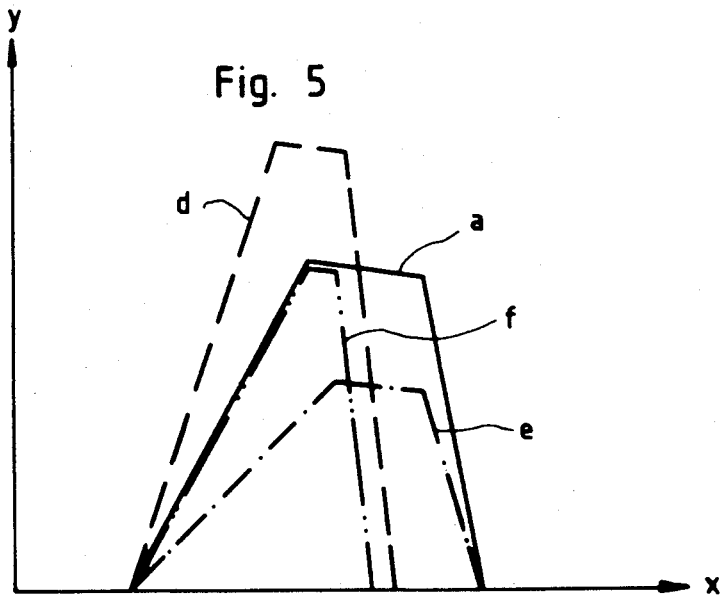

In the case of a once fixed fuel injector, during operation adaptations can still take place to the load point via variations in the pressure, the switch-on duration and switch-on time of the solenoid or magnetic valve. FIG. 5 shows in a representation identical to that of FIG. 4, how such measures can be used for further varying the course of the fuel injection in the case of a fuel injection installation or means constructed according to the invention.

For comparison purposes, curve 5 again shows curve as of FIG. 4: Curve d represents the fuel injection course in the case of a higher system pressure and shorter switch-on time of the solenoid or magnetic valve 44. The fuel injection quantity is the same as in the case of curve a. The fuel injection quantity per fuel injection can be reduced by reducing the system pressure (curve e) or by a shorter switch-on duration (curve f).

It can be gathered from what has been stated hereinbefore that the inventive fuel injection installation or means makes it possible to adapt the fuel injection pattern to the requirements of different engines and to bring about significant improvements compared with known fuel injection installations, particularly with respect to the combustion noise and emissions of toxic exhaust constituents, but also with respect to the efficiency.

While there are shown and described present preferred embodiments of the invention, it is to be distinctly understood that the invention is not limited thereto, but may be otherwise variously embodied and practiced within the scope of the following claims.

Accordingly, what we claim is:

1. A fuel injection installation for an internal combustion engine having engine cylinders, especially a diesel engine, comprising:

at least one electrically operated fuel injector provided for each engine cylinder;

a continuously delivering fuel pump operatively associated with the fuel injectors;

a common pressure reservoir connected upstream of the fuel injectors and subject to the action of the continuously delivering fuel pump as a function of engine speed and load;

each fuel injector being provided with an annular chamber, a throttle and a channel;

said common pressure reservoir being continuously connected by means of the annular chamber and the throttle to the channel in each fuel injector;

a solenoid valve provided for each fuel injector and operable for each fuel injection process;

each fuel injector comprising means defining a fuel injection opening for feeding fuel to the associated engine cylinder;

each fuel injector further comprising a nozzle needle cooperating with said fuel injection opening for closing said fuel injection opening;

a pressure chamber provided for each fuel injector at a location directly upstream of the fuel injection opening;

a fuel return pipe operatively associated with each of said fuel injectors;

said solenoid valve of each fuel injector when operated connecting said channel of the related fuel injector to said fuel return pipe and thereby relieving the nozzle needle closing the fuel injection opening and releasing the discharge of fuel from said pressure chamber located directly upstream of the fuel injection opening;

means providing a further pressure chamber for each fuel injector and located in the region thereof;

each fuel injector further containing channel means having a length matched to a predetermined ignition delay time; and said pressure chamber located directly upstream of the fuel injection opening of each fuel injector being connected by said channel means to said further pressure chamber associated with such fuel injector and by means of said further pressure chamber to the common pressure reservoir.

2. The fuel injection installation as defined in claim 1, wherein:

each fuel injector further comprises:

a control chamber for controlling movement of the nozzle needle;

a check valve through which extends a throttle bore; and said channel of each fuel injector being constantly connected by means of said throttle bore of said check valve to said control chamber controlling the nozzle needle movement.

3. The fuel injection installation as defined in claim 1, further including:

a fuel supply pipe located between the common pressure reservoir and a related fuel injector; and said means defining said further pressure chamber for each fuel injector comprises for each fuel injector a pressure tank which is arranged in said fuel supply pipe located between the common pressure reservoir and the related fuel injector.

4. The fuel injection installation as defined in claim 1, wherein:

said further pressure chamber is formed by a predeterminate dimensioning of a fuel supply pipe located between the common pressure reservoir and a related fuel injector.

5. The fuel injection installation as defined in claim 1, further including:

fuel supply pipe means located between the common pressure reservoir and the fuel injectors; and a throttle arranged in said fuel supply pipe means located between the common pressure reservoir and the fuel injectors.

6. The fuel injection installation as defined in claim 2, wherein:

the check valve through which extends the throttle bore comprises an easily replaceable disk.

7. The fuel injection installation as defined in claim 1, wherein:

each fuel injector comprises an armature guide part;

each solenoid valve comprising a valve body;

said valve body of each solenoid valve being constructed as an armature and sliding in said armature guide part;

said valve body and armature guide part having a length which solely determines the armature stroke; and said valve body and armature guide part being exchangeable.

8. The fuel injection installation as defined in claim 1, wherein:

each solenoid valve comprises magnet core parts; and a non-magnetic spacer, provided between the magnet core parts of the solenoid valve.

9. The fuel injection installation as defined in claim 8, wherein:

said non-magnetic spacer defines a gap provided between the magnet core parts of the solenoid valve.

10. The fuel injection installation as defined in claim 1, wherein:

each solenoid valve comprises magnet core parts; and a magnet armature; and a non-magnetic spacer provided between the magnet core parts of the solenoid valve and the magnet armature.

11. The fuel injection installation as defined in claim 10, wherein:

said non-magnetic spacer defines a gap provided between the magnet core parts and the magnet armature.

12. The fuel injection installation as defined in claim 1, further including:

a fuel-metering valve connected upstream of the continuously delivering fuel pump.

* * * * *

UNITED STATES PATENT AND TRADEMARK OFFICE

CERTIFICATE OF CORRECTION

PATENT NO. : 4,719,889

DATED : January 19, 1988

INVENTOR(S) : GERNOT AMANN et al

It is certified that error appears in the above-identified patent and that said Letters Patent is hereby corrected as shown below:

Column 8, line 36, please delete "as" and insert --a--

Signed and Sealed this

Twenty-sixth Day of July, 1988

*Attest:*

DONALD J. QUIGG

*Attesting Officer*

*Commissioner of Patents and Trademarks*